US006186644B1

(12) United States Patent
Mosseau

(10) Patent No.: US 6,186,644 B1
(45) **Date of Patent: *Feb. 13, 2001**

(54) DECORATIVE LIGHTING SYSTEM WITH LIGHT STRING MOUNTING CHANNEL

(76) Inventor: Raymond Mosseau, 772 South Selkirk, Thunder Bay, Ontario (CA), P7E 1V2

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/149,123

(22) Filed: Sep. 9, 1998

(51) Int. Cl.[7] ..... F21V 21/00

(52) U.S. Cl. ..... 362/249; 362/125; 362/151; 362/252

(58) Field of Search ..... 362/125, 151, 362/249, 252, 389, 397

(56) References Cited

U.S. PATENT DOCUMENTS

| | | | | |
|---|---|---|---|---|
| 4,357,653 | * | 11/1982 | Kovacs | 362/252 |
| 4,821,158 | * | 4/1989 | Mitten | 362/125 |
| 4,995,181 | * | 2/1991 | Wolf | 40/714 |
| 5,067,061 | | 11/1991 | Prickett | 362/145 |
| 5,161,882 | * | 11/1992 | Garrett | 362/252 |
| 5,416,678 | | 5/1995 | Schabowski | 362/249 |
| 5,544,028 | | 8/1996 | Carlin | 362/249 |
| 5,559,681 | | 9/1996 | Duarte | 362/252 |
| 5,791,762 | * | 8/1998 | Wroblewski | 362/252 |
| 5,865,516 | * | 2/1999 | Woy | 312/125 |

FOREIGN PATENT DOCUMENTS

| | | |
|---|---|---|
| 1075216 | 4/1980 | (CA) . |
| 1093522 | 1/1981 | (CA) . |
| 2092976 | 10/1994 | (CA) . |

* cited by examiner

*Primary Examiner*—Alan Cariaso
*Assistant Examiner*—Ronald E. Delgizzi
(74) *Attorney, Agent, or Firm*—Murray E. Thrift; Adrian D. Battison; Michael R. Williams

(57) ABSTRACT

A decorative lighting system is used with a string of lights, usually of the "mini-light" type. A string of lights is mounted in an extruded plastic channel, with the light sockets engaged in respective apertures spaced along one side of the channel. A cap snap fits over the open side of the channel to form a complete box section housing all the wiring and inner ends of the light sockets. The resulting unit is mounted on a window using an appropriate fastener, preferably hook and loop fastener, along the channel base and the window pane.

16 Claims, 2 Drawing Sheets

FIG. 2
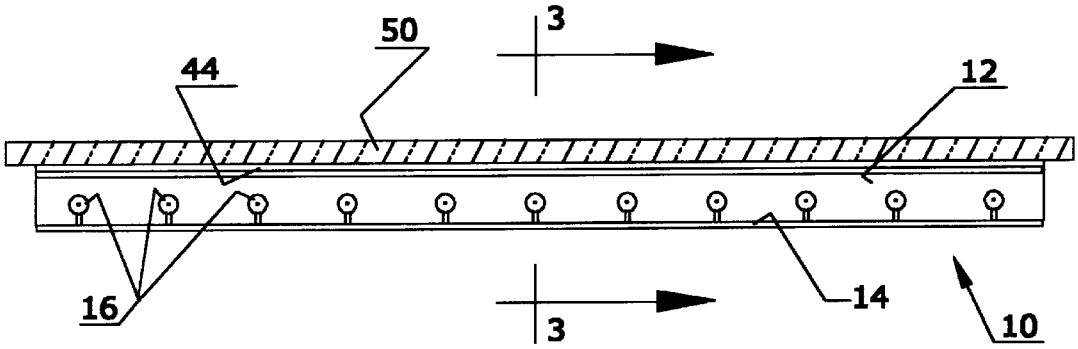
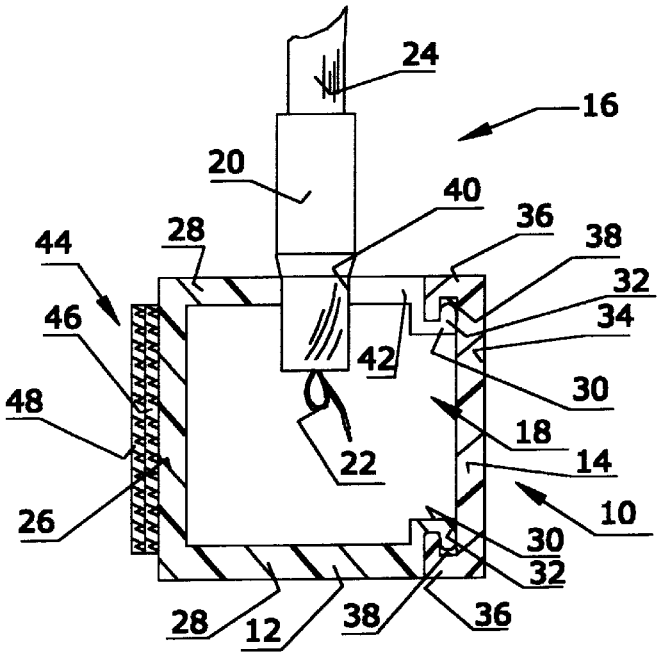
FIG. 3

DECORATIVE LIGHTING SYSTEM WITH LIGHT STRING MOUNTING CHANNEL

FIELD OF THE INVENTION

The present invention relates to decorative lighting and more particularly to a system for mounting strings of decorative electric lights.

BACKGROUND

Decorative lights are often mounted around windows during festive occasions, notably over Christmas. These lights are often small, "mini-light" strings in sequence on flexible wires. In most cases, mounting the lights involves stretching the wires around a window and fastening the strings in place with tape, tacks or hooks. This is a laborious process and does not always yield reliable or aesthetically pleasing results.

One attempt to solve this problem is disclosed in U.S. Pat. No. 5,544,028 issued Aug. 6, 1996, to T. Christoper Carlin. The patent discloses a channel with convergent sides that clamp onto the bulb sockets. This channel has limited utility since only the base is flat and can be used for mounting the string. It is not useful, for example, where there is no flat surface perpendicular to and surrounding a window pane. Installation of the lighting string in the closed channel with the lights at uniform spacings may also prove problematic.

The present invention is concerned with a system that ameliorates the problems of the prior art.

SUMMARY

According to the present invention there is provided a decorative lighting system for use with a string of lights including a plurality of bulb sockets linked by elongate, flexible wires, said system comprising:

an elongate channel having a base web and spaced apart flanges projecting perpendicularly from one side of the base web;

a plurality of apertures spaced along one of the flanges, the apertures being configured to engage respective ones of the bulb sockets; and a plurality of slots extending from respective ones of the apertures to a free edge of said one of the flanges.

The light sockets thus fit into preformed apertures to provide the desired spacing of the sockets. Because the lights are mounted on one flange of a right-angled channel, there are two orthogonal surfaces that can be used for mounting the channel, so that the system is more universal in its application.

In preferred embodiments, a cap extends over the open side of the channel and is a snap fit in place to provide an aesthetically pleasing appearance.

BRIEF DESCRIPTION OF THE DRAWINGS

In the accompanying drawings, which illustrate an exemplary embodiment of the present invention:

FIG. 2 is a plan view of the system; and

FIG. 3 is a cross-sectional view along line 3—3 of FIG. 1.

DETAILED DESCRIPTION

Figure 1:
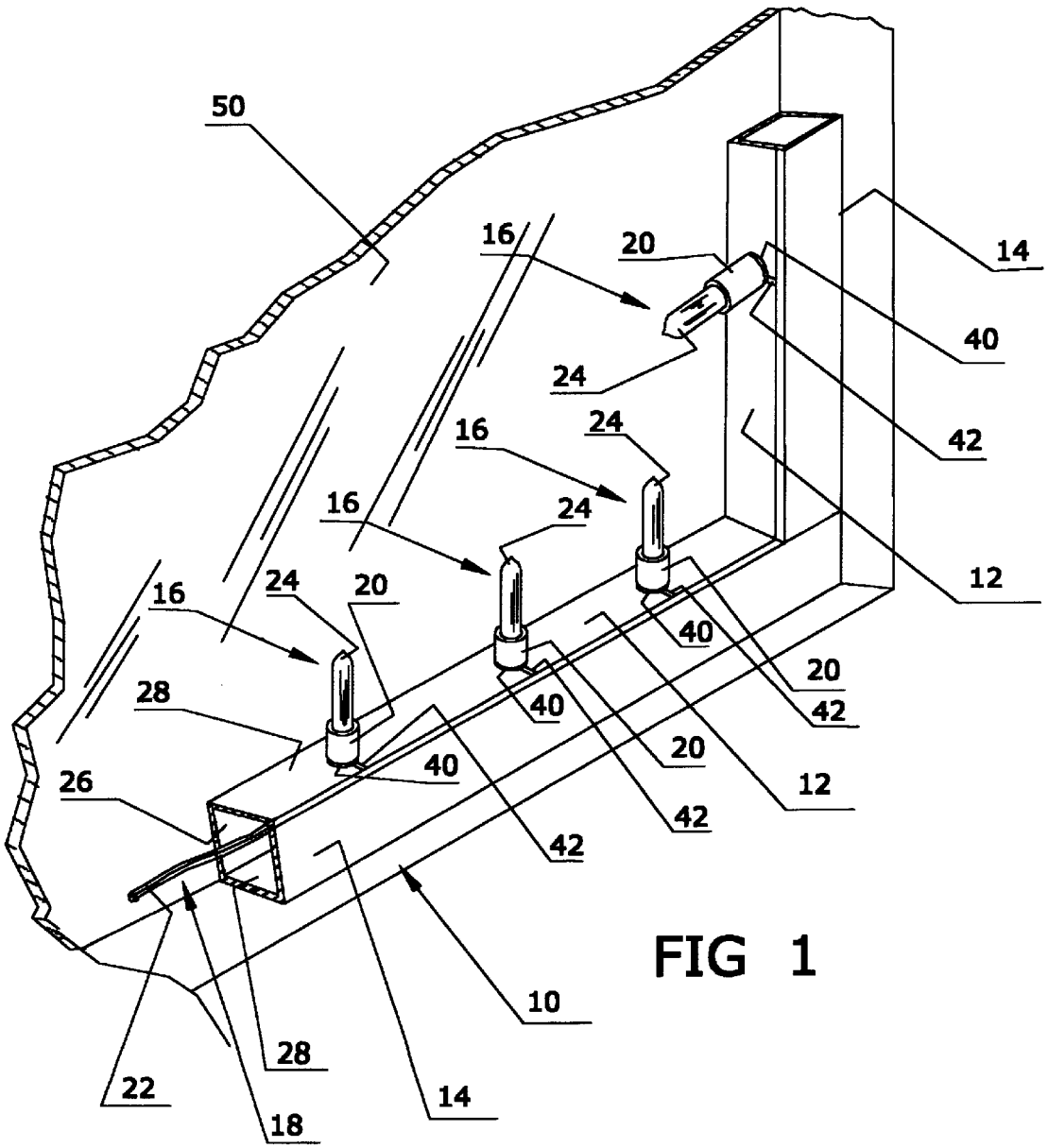
FIG. 1 is an isometric view of a system according to the present invention.

Referring to the accompanying drawings, there is illustrated a decorative light system 10 that includes an extruded thermoplastic channel 12 with a snap-on cap 14. A set of lights 16 is mounted on the channel 12 as will be described in more detail in the following.

The lights are part of a light string 18 including a set of sockets 20 spaced along and mounted on electric wires 22. Each of these sockets receives a small light bulb 24 which is illuminated when electric power is supplied to the wires 22.

The channel 12 has a flat base web 26. Two flanges 28 project perpendicularly from the opposite edges of the web 26. At the free edge of each flange is an edge portion 30 offset towards the center of the channel. A bead 32 is formed on the outer face of this offset edge portion.

The cap 14 that closes the open side of the channel 12 includes a flat cap panel 34 with two edge flanges 36 projecting perpendicularly from the free edges of the cap panel. Each of the flanges 36 has a groove 38 along its length to receive the bead 32 of the respective of the offset edge portions 30 of the channel flanges. The cap, like the base, is extruded from thermoplastic material and is a snap fit over the open side of the channel 12.

One of the flanges 28 of the channel 12 has a set of apertures 40 formed in it at spaced positions along the length of the flange. Slots 42 lead from the apertures to the free edge of the flange.

The apertures 40 are sized to receive and to hold frictionally the sockets 20 of the light string 18. The apertures must thus be spaced no further apart than are the sockets on their wires. The slots 42 provide the apertures with some resiliency in order to grip the sockets. Where necessary, the wires can be passed through the slots to the apertures.

The lighting unit is fixed in place using a fastener 44. This is a hook and loop fastener with one component 46 attached to the channel web 26 and the other component 48 attached to a window pane 50, although the fastener may also be installed between the flange opposite the light sockets and another flat surface.

The installation and removal of the light unit is a very simple process. Once the unit is assembled, it is simply a matter of adhering the fastener to the surface to which it is to be mounted and locating the strip in place. A set of four strips is easily mounted around a window. For large installations and unusual shapes, several units may be arranged in the appropriate way, either end-to-end or arranged at angles to one another. When dismounted, the system is easily stored ready for reinstallation without wrapping and unwrapping of loose wires.

While one embodiment of the present invention has been described in the foregoing, it is to be understood that other embodiments are possible within the scope of the invention and are intended to be included herein.

What is claimed is:

1. A decorative lighting system for use with a string of lights including a plurality of bulb sockets linked by elongate, flexible wires, said system comprising:

an elongate channel having a base web, spaced apart flanges each flange projecting perpendicularly from one side of the base web to a free edge of the flange, an open side opposite the web, between the free edges of the flanges and open ends;

a plurality of apertures in one of the flanges and spaced along said one of the flanges between the web and the free edge of said one of the flanges the apertures being configured to engage respective ones of the bulb sockets; and a plurality of slots in said one of the flanges extending from respective ones of the apertures to the free edge of said one of the flanges.

2. A lighting system according to claim 1 including a cap engagable over the open side of the channel for closing the open side.

3. A lighting system according to claim 2 including inter-engaging formations on the cap and channel for holding the cap in place on the channel.

4. A lighting system according to claim 1 including fastener means for securing the channel to a surface.

5. A lighting system according to claim 4 where the fastener means comprise inter-engaging fastener components on the web and on the surface.

6. A system according to claim 4 wherein the fastener means comprise a hook and loop fastener.

7. A system according to claim 5 wherein the fastener means comprise a hook and loop fastener.

8. A lighting system according to claim 4 wherein the fastener means are mounted on the web.

9. A lighting system according to claim 8 where the fastener means comprise inter-engaging fastener components on the web and on the surface.

10. A system according to claim 9 wherein the fastener means comprise a hook and loop fastener.

11. A decorative lighting system to be mounted on a surface, said system comprising:

a string of lights including a plurality of bulb sockets linked by elongate, flexible wires;

an elongate channel having a base web, spaced apart flanges, each flange projecting perpendicularly from a respective side of the base web to a free edge of the flange, an open side opposite the web, between the free edges of the flanges, and opposite open ends;

a plurality of apertures in one of the flanges spaced along said one of the flanges between the web and the free edge of said one of the flanges, the bulb sockets being engaged in respective ones of the apertures;

a plurality of slots in said one of the flanges extending from respective ones of the apertures to the free edge of said one of the flanges; and a cap engaged removably over the open side of the channel.

12. A lighting system according to claim 10 including inter-engaging formations on the cap and channel for holding the cap in place on the channel.

13. A lighting system according to claim 11 including fastener means for securing the channel to said surface.

14. A system according to claim 13 wherein the fastener means comprise a hook and loop fastener.

15. A lighting system according to claim 13 where the fastening means comprise inter-engaging fastener components on the web and on the surface.

16. A system according to claim 15 wherein the fastener means comprise a hook and loop fastener.

* * * * *

UNITED STATES PATENT AND TRADEMARK OFFICE

CERTIFICATE OF CORRECTION

PATENT NO. : 6,186,644 B1
DATED : February 13, 2001
INVENTOR(S) : Raymond Mousseau It is certified that error appears in the above-identified patent and that said Letters Patent is hereby corrected as shown below:

Title page,
Change the inventor's surname, both occurences on the title page, from "Mosseau" to -- Mousseau --

Signed and Sealed this

Thirtieth Day of October, 2001

*Attest:*

Nicholas P. Godici

NICHOLAS P. GODICI
*Acting Director of the United States Patent and Trademark Office*

*Attesting Officer*